US007422010B2

(12) United States Patent
Gama et al.

(10) Patent No.: US 7,422,010 B2
(45) Date of Patent: Sep. 9, 2008

(54) COOKING STOVE

(75) Inventors: Atsuhito Gama, Nagoya (JP); Shinichiro Hata, Nagoya (JP); Hiroyuki Yamada, Nagoya (JP); Kazuya Hirota, Nagoya (JP)

(73) Assignee: Rinnai Corporation, NAgoya-shi (JP)

( * ) Notice: Subject to any disclaimer, the term of this patent is extended or adjusted under 35 U.S.C. 154(b) by 510 days.

(21) Appl. No.: 11/091,701

(22) Filed: Mar. 29, 2005

(65) Prior Publication Data

US 2005/0236391 A1 Oct. 27, 2005

(30) Foreign Application Priority Data

Mar. 31, 2004 (JP) ..... 2004-102483
Apr. 2, 2004 (JP) ..... 2004-110388

(51) Int. Cl.
*F24C 3/00* (2006.01)
*H05B 3/68* (2006.01)

(52) U.S. Cl. ..... 126/39 BA; 126/39 E; 700/90; 219/445.1; 219/446.1; 219/447.1; 219/448.11; 219/448.12; 219/448.13; 431/24; 431/66; 431/67; 431/68

(58) Field of Classification Search ..... 126/39 BA, 126/39 E; 219/445.1, 446.1, 447.1, 448.11, 219/448.12, 448.13; 431/18, 24–5, 27, 29, 431/66–73; 700/90
See application file for complete search history.

(56) References Cited

U.S. PATENT DOCUMENTS 4,997,161 A 3/1991 Hutchison et al. ..... 251/129.08
5,241,463 A 8/1993 Lee ..... 364/400

FOREIGN PATENT DOCUMENTS

| | | |
|---|---|---|
| JP | 58-186302 | 12/1983 |
| JP | 62-171704 | 10/1987 |
| JP | 63-156924 | 6/1988 |
| JP | 1-160208 | 11/1989 |
| JP | 04-093525 | 3/1992 |

(Continued)

OTHER PUBLICATIONS

European Search Report dated Jul. 18, 2005.

(Continued)

*Primary Examiner*—Shawntina Fuqua
(74) *Attorney, Agent, or Firm*—Edwards Angell Palmer & Dodge LLP

(57) ABSTRACT

A cooking stove that prevents a burner from being ignited when a touch switch shifts from a non-sensing to a sensing state. An operation portion having a touch switch is provided on a glass top plate of a cooking stove main body which accommodates burners. The touch switch allowing a user to give instruction on actuation and stoppage of the burners and sensing an object that contacts or approaches the top surface of the glass to plate. Heating control means for determining whether the touch switch is on (a sensing state) or off (a non-sensing state) to control actuation of the heating means. While the burner is at a stop, when the touch switch is turned on and then off again, the heating control means ignites the burner. While the burner is in operation, when the touch switch is turned on, the heating control means extinguishes the burner.

8 Claims, 10 Drawing Sheets

FOREIGN PATENT DOCUMENTS

| | | |
|---|---|---|
| JP | 07-044816 | 11/1995 |
| JP | 2003-262345 | 9/2003 |
| JP | 2003-303674 | 10/2003 |
| WO | WO 01/29483 | 4/2001 |

OTHER PUBLICATIONS

Office Action for Japanese Application No. JP2004-110388, mailed Jul. 10, 2007.

Office Action for Japanese Application Serial No. 2004-102483, mailed Jun, 19, 2007.

COOKING STOVE

BACKGROUND OF THE INVENTION

1. Field of the Invention

The present invention relates to a cooking stove comprising heating means, and in particular, to a cooking stove comprising an operation section that indicates an operation of heating means on a top surface of a top plate.

2. Description of the Related Art

A drop-in type cooking stove is conventionally known in which a cooking stove main body 101 is buried in an opening formed in a counter top of a system kitchen as shown in FIG. 10. Operation knobs 103*a* and 103*b* are provided on a glass top plate 102 to ignite and extinguish gas burners 100*a* and 100*b* and to adjust thermal power; the glass top plate 102 covers a top surface of the cooking stove main body 101 in which gas burners 100*a* and 100*b* are accommodated (see, for example, Japanese Utility Model Laid-Open No. 58-186302 (1983)).

Such a cooking stove eliminates the need to form an opening through which an operation section is viewed, in a front surface of the counter top as in the case in which a cooking stove comprising an operation section in a front surface is installed. The cooking stove can be easily installed in the counter top. Further, the gas burners can be ignited and extinguished and thermal power adjusted using the operation knobs 103*a* and 103*b*, provided on the top plate 102 and which are thus easy to see. Consequently, a user can operate the cooking stove more easily and effectively.

In accordance with the cooking stove shown in FIG. 10, however, the operation knobs 103*a* and 103*b* are arranged so as to project from the top surface of the glass top plate 102. Accordingly, the operation knobs 103*a* and 103*b* may obstruct cooking. Thus, for example, a detecting section of an electrical-capacitance sensor may be provided on a back surface of the glass top plate 102 as means for operating the gas burners 100*a* and 100*b*. On the other hand, a touch switch comprising an operation section may be constructed on a front surface of the glass top plate 102. Further, the top surface of the glass top plate 102 may be made flat.

However, if the touch switches are provided as described above, any of them may be turned on when covered with a cooked material boiling over from a pan or the like placed on trivets 104*a* and 104*b* or with an object falling onto the glass top plate 102. Further, a child may tamper with any of the touch switches or a user may unconsciously touch any of the touch switches.

Thus, for example, while cooking is being carried out using only the right burner 100*b*, a lighting switch for the left burner 100*a* may be turned on by a cooked material boiling over from a pan placed on the trivet 104*b* of the right burner 100*b*. In this case, the left burner 100*a* is ignited.

It is thus an object of the present invention to eliminate these disadvantages to provide a cooking stove that prevents a burner from being ignited when a touch switch shifts from a non-sensing state to a sensing state contrary to a user's expectations owing to, for example, a factor different from the user's operation.

SUMMARY OF THE INVENTION

To accomplish the above object, the present invention relates to improvements in a cooking stove comprising a touch switch provided on a top plate covering a top surface of a cooking stove main body accommodating heating means, allowing a user to give an instruction on actuation and stoppage of the heating means, the touch switch sensing an object contacting with or approaching the top surface of the top plate, and heating control means for determining whether the touch switch is in a sensing state or a non-sensing state to control actuation of the heating means in accordance with a result of the determination.

The present invention is characterized in that while the heating means is at a stop, when the touch switch shifts from the non-sensing state to the sensing state and then back to the non-sensing state, the heating control means starts actuating the heating means, and in that while the heating means is in operation, when the touch switch shifts from the non-sensing state to the sensing state, the heating control means stops actuating the heating means.

According to the present invention, when the touch switch shifts from the non-sensing state to the sensing state and then back to the non-sensing state, the heating control means starts actuating the heating means. Thus, even if the touch switch shifts to the sensing state when covered with a boiling-over cooked material or a fallen object (cloth or the like) falling onto the top plate, the heating control means does not start actuating the heating means because the touch switch has not returned to the non-sensing state.

Moreover, while the heating means is in operation, when the touch switch shifts from the non-sensing state to the sensing state, the heating control means stops actuating the heating means. To start actuating the heating means, the user must touch the touch switch with his or her finger and then take off the finger. However, to stop the heating means, the user can stop the operation of the heating simply by touching the touch switch with his or her finger. The cooking stove is thus convenient.

The present invention is also characterized by further comprising a plurality of the touch switches, and in that while the heating means is at a stop, when at least pre-selected two of the plurality of switches shift from the non-sensing state to the sensing state, the heating control means starts actuating the heating means.

According to the present invention, when at least pre-selected two of the plurality of switches shift from the non-sensing state to the sensing state, the heating control means starts actuating the heating means. Thus, when the user unconsciously touches one of the touch switches or only one of the touch switches shifts from the non-sensing state to the sensing state owing to a child's tampering or a boiling-over cooked material, the heating means is not activated. This makes it possible to prevent the heating means from being activated contrary to the user's expectations.

Further, the present invention is characterized in that while the heating means is at a stop, when at least pre-selected two of the plurality of switches shift from the non-sensing state to the sensing state in a preset order, the heating control means starts actuating the heating means.

According to the present invention, when a plurality of pre-selected switches shift from the non-sensing state to the sensing state and then back to the non-sensing state in a preset order, the heating control means starts actuating the heating means. It is assumed that the plurality of touch switches are very unlikely to shift from the sensing state to the non-sensing state and then back to the sensing state in the above order because of a boiling-over cooked material or a fallen object. This makes it possible to inhibit the heating means from being actuated when the touch switch mistakenly senses a boiling-over cooked material or a fallen object.

Furthermore, the present invention is characterized by further comprising heat quantity changing means for changing the heat quantity of the heating means, and in that the plurality of touch switches include an actuation ready switch used to allow the heating means to be activated and a heat quantity up switch used to instruct the heat quantity changing means to increase the heat quantity of the heating means, and in that when the actuation ready switch shifts from the non-sensing state to the sensing state and then the heat quantity up switch shifts from the non-sensing state to the sensing state, in accordance with the preset order, the heating control means starts actuating the heating means.

According to the present invention, the heat quantity up switch is also used to give an instruction on actuation of the heating means. This enables a reduction in the number of touch switches to be prepared. Further, an operation of starting actuating the heating means is conceptually contained in an "instruction on an increase in heat quantity". Accordingly, the user does not have an incongruous feeling when operating the heat quantity up switch to give an instruction on actuation of the heating means. Therefore, the user can conveniently use the cooking stove.

The present invention is characterized by further comprising at least two heating means, and in that one of the plurality of switches is an operation switch used to shift between an operation state in which the user can operate the other touch switches and a standby switch in which the user cannot operate the other touch switches, and in the operation state, when the at least two of the plurality of touch switches shift from the non-sensing state to the sensing state, the two touch switches being pre-selected for the respective heating means and being different from the operation switch, the heating control means start actuating the heating means corresponding to the at least two touch switches.

According to the present invention, if in the standby state, an instruction is given on actuation of any of the heating means, the user first operates the operation switch to switch the standby state to the operation state. Thus, even if the process of starting actuating the heating means is executed when any one of the other touch switches shifts from the non-sensing state to the sensing state, two touch switches must be operated in order to give an instruction on actuation of the heating means.

It is assumed that in the operation state, while one of the at least two heating means is in operation, an instruction is given on actuation of a second heating means. Then, if a process of starting actuating the second heating means is executed when a touch switch different from the operation switch shifts from the non-sensing state to the sensing state, the operation of the one touch switch starts actuating the second heating means. In this case, when one touch switch shifts from the non-sensing state to the sensing state owing to the user's unconscious operation, a child's tampering, or the like, the second heating means starts to be activated.

Thus, according to the present invention, when at least two touch switches different from the operation switch shift from the non-sensing state to the sensing state, the heating means starts to be actuated. This makes it possible to prevent one of the at least two heating means from starting to be actuated contrary to the user's expectations.

Moreover, the present invention is characterized by further comprising heat quantity changing means provided individually for the at least two heating means, and in that the plurality of touch switches include actuation ready switches provided individually for the at least two heating means to allow each heating means to be activated and heat quantity up switches used to instruct the heat quantity changing means to increase the heat quantities of the respective heating means, and in that in the operation state, when the actuation ready switch provided for one of the heating means shifts from the non-sensing state to the sensing state and then the heat quantity up switch provided for the heating means shifts from the non-sensing state to the sensing state, the heating control means starts actuating the heating means.

According to the present invention, if at least two of the heating means are provided and the actuation ready switch and the heat quantity up switch are provided individually for each heating means, the heat quantity up switch is also used to given an instruction on actuation of the heating means. This eliminates the need for providing exclusive switches each used to give an instruction on actuation of the corresponding heating means. This enables a reduction in the number of touch switches to be prepared.

Further, the present invention is characterized in that when the heating means is in operation and one of the pre-selected touch switches shifts from the non-sensing state to the sensing state, the heating control means stops actuating the heating means.

According to the present invention, when the heating means is in operation, the heating control means knows that an instruction on actuation of the heating means has shifted all the preset switches from the sensing state to the non-sensing state. Thus, all the pre-selected touch switches were not in a failure state in which they cannot be shifted from the non-sensing state to the sensing state.

Thus, by stopping the operation of the heating means when any of the pre-selected touch switches shifts from the non-sensing state to the sensing state, it is possible to reduce the possibility that a failure in any touch switch prevents the operation of the heating means from being stopped.

Moreover, the present invention is characterized by further comprising lighting means provided on the top plate; and lighting control means for, while the heating means is in operation, lighting the lighting means, and while the heating means is in suspension, when the touch switch shifts from the non-sensing state to the sensing state, lighting the lighting means before the heating control means starts actuating the heating means.

According to the present invention, when the user touches the touch switch with his or her finger to give an instruction on actuation of the heating means, the heating control means actually starts actuating the heating means when the user takes his or her finger off the touch switch. Thus, if there is a long time interval after the user has touched the touch switch and before the user takes his or her finger off, then nothing changes in spite of the touch with the touch switch. Consequently, the user may have an incongruous feeling.

Thus, when the touch switch shifts from the non-sensing state to the sensing state, the lighting control means lights the lighting means before the heating control means starts actuating the heating means. The user can thus be noticed that an instruction on actuation of the heating means has been accepted. This inhibits the user from having an incongruous feeling.

DETAILED DESCRIPTION OF THE PREFERRED EMBODIMENT

Figure 2:
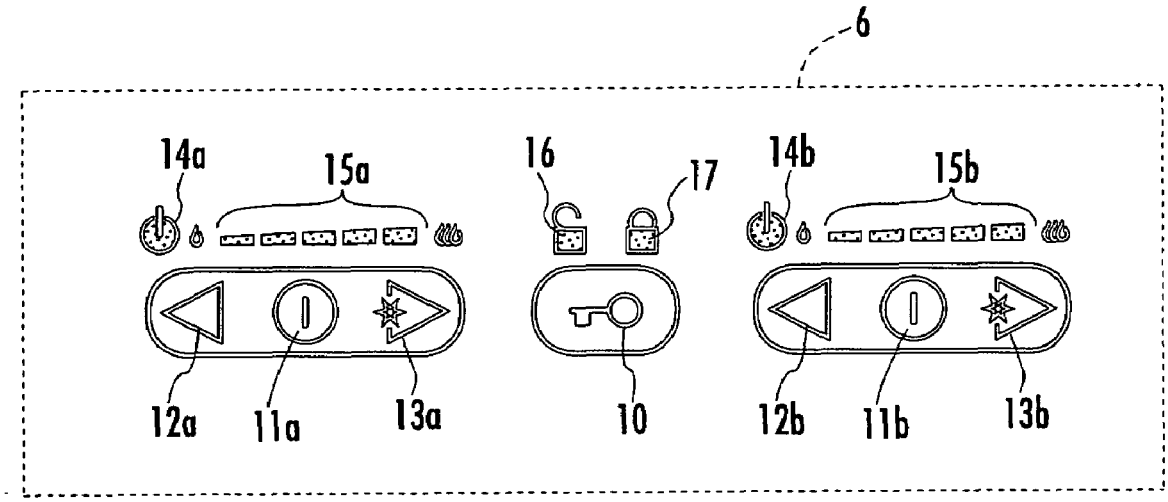
FIG. 2 is a detailed diagram of an operation section shown in FIG. 1.
Figure 3:
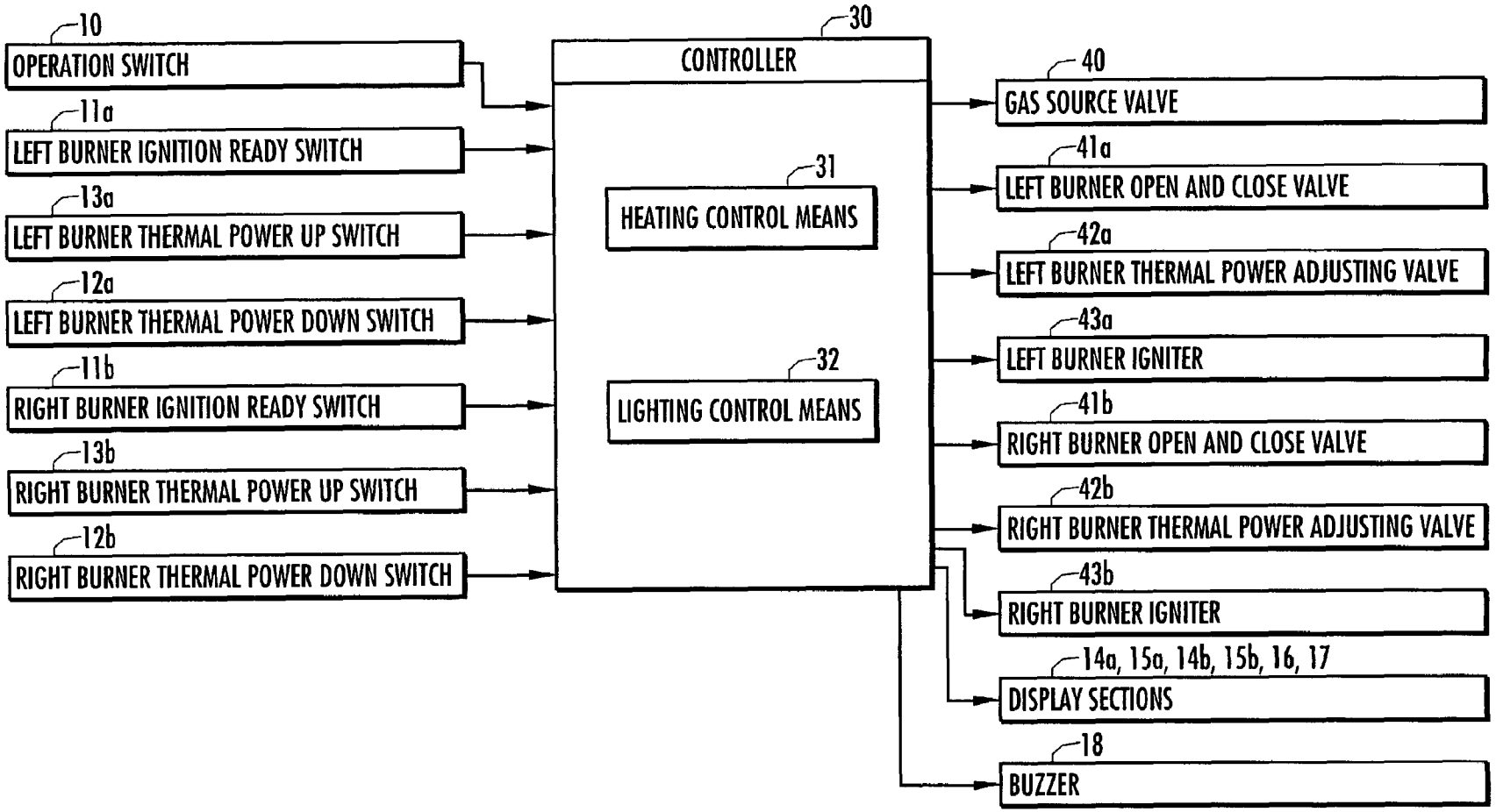
FIG. 3 is a control block diagram of the cooking stove.
Figure 4:
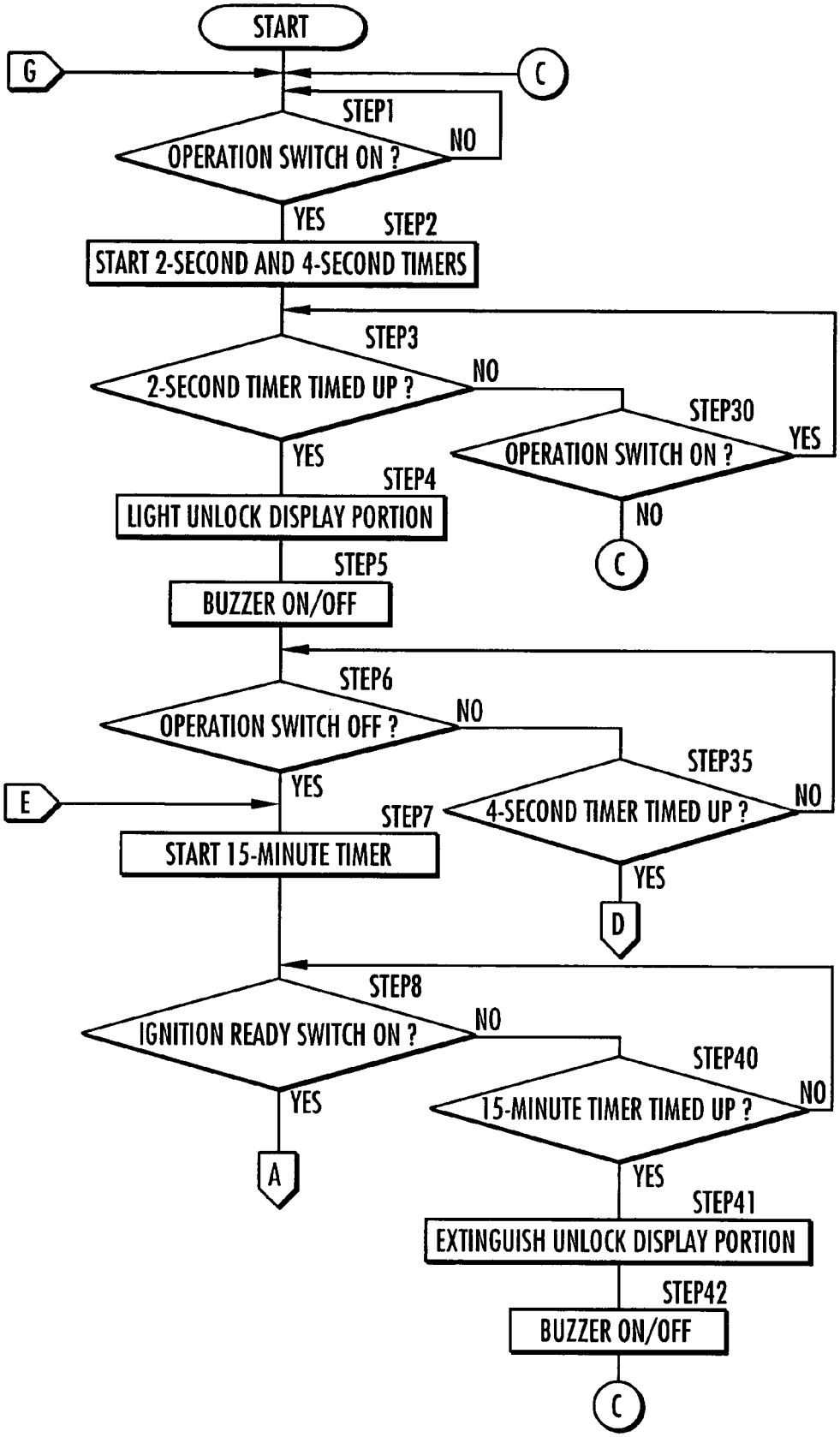
FIG. 4 is a flowchart of a process of igniting a burner.
Figure 5:
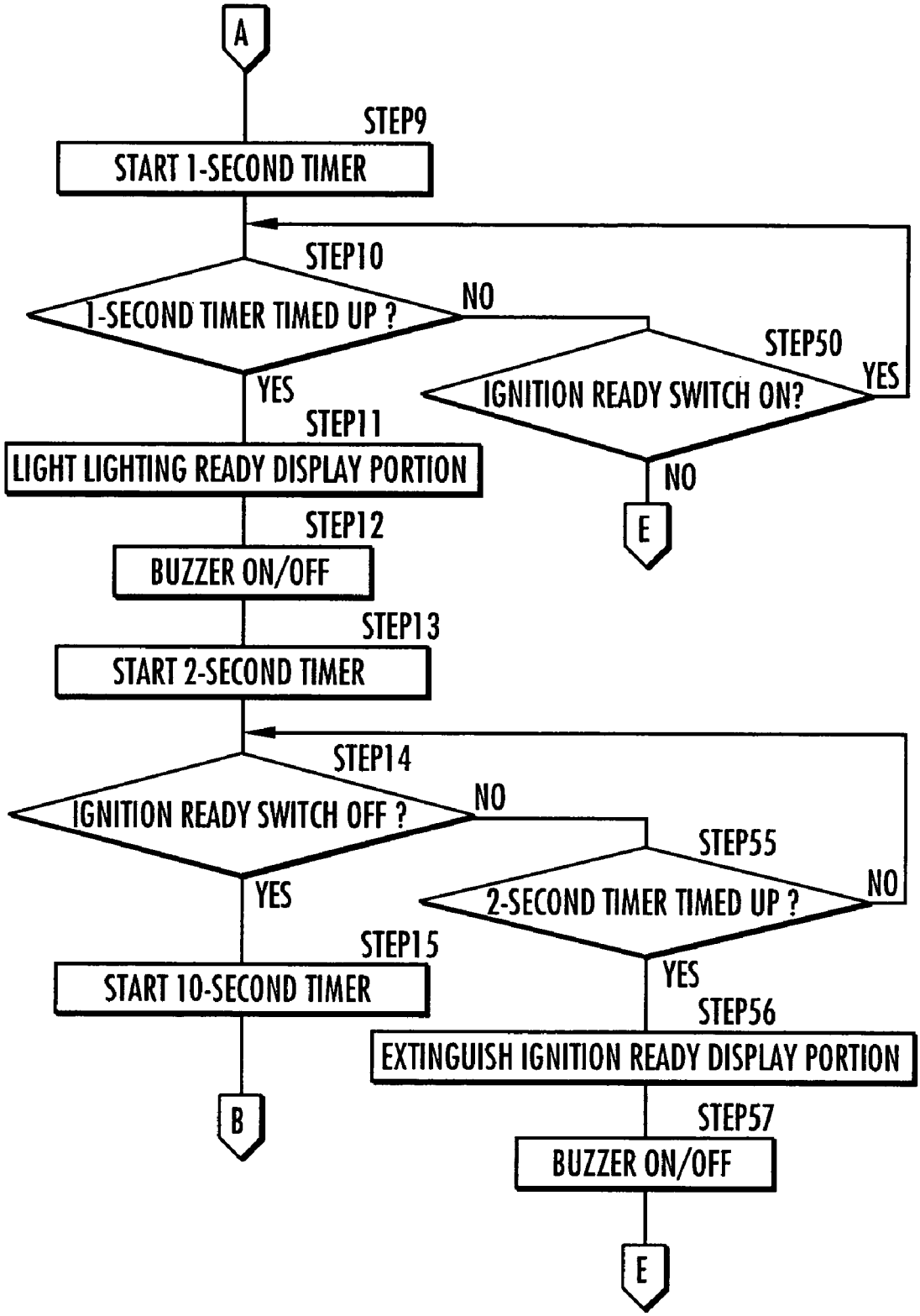
FIG. 5 is a flowchart of a process of igniting a burner.
Figure 6:
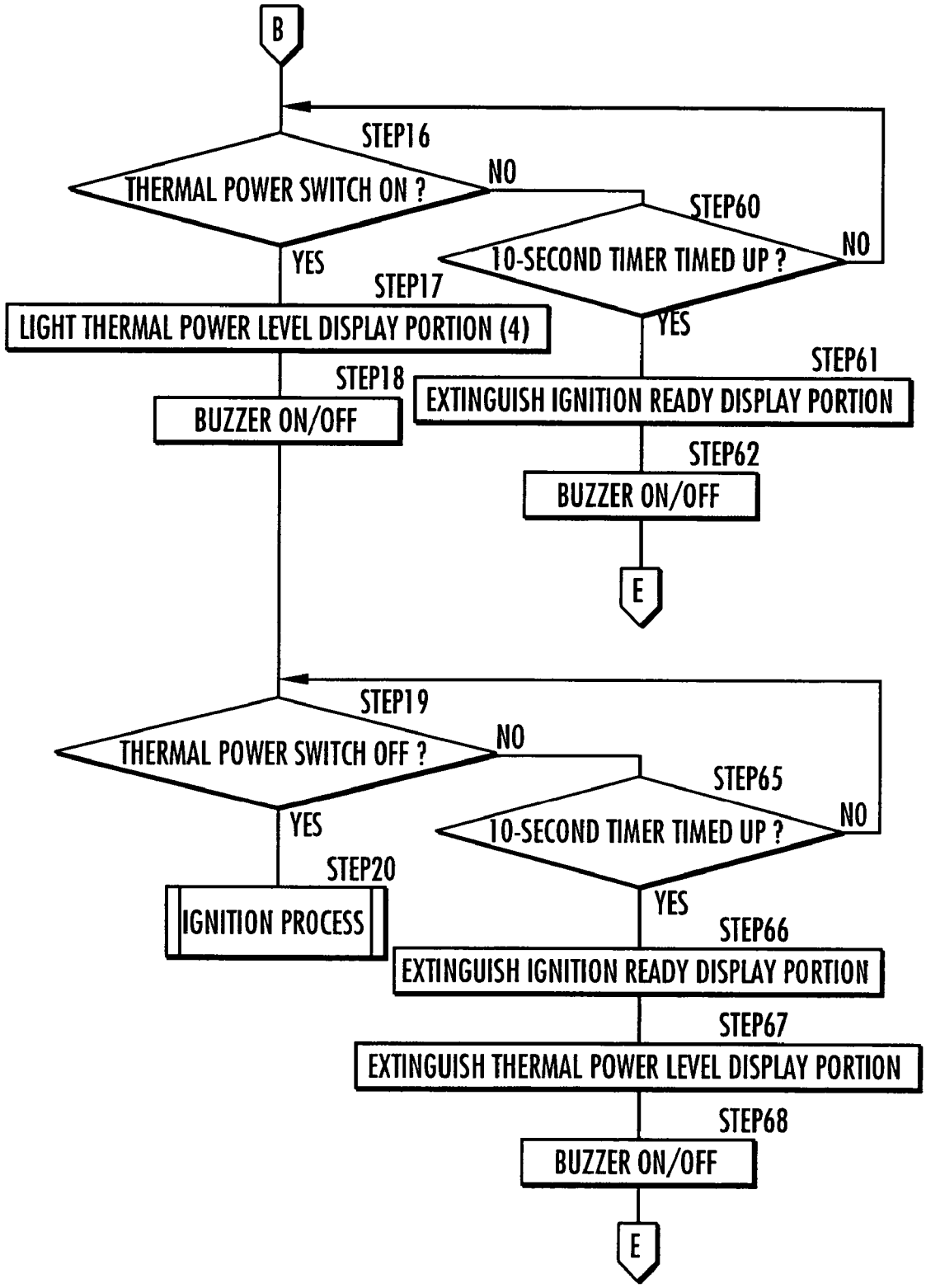
FIG. 6 is a flowchart of a process of igniting a burner.
Figure 7:
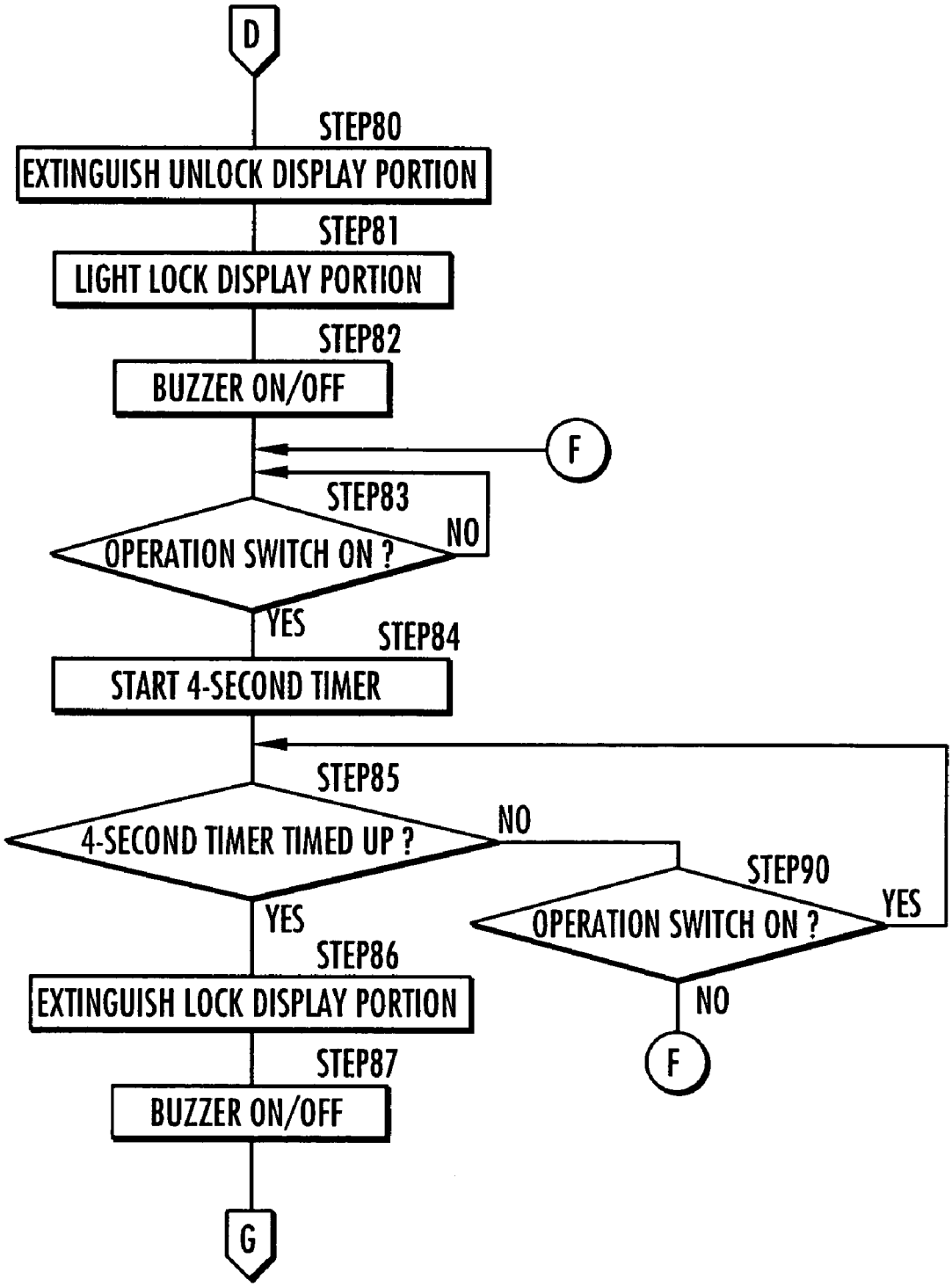
FIG. 7 is a flowchart of child lock and child unlock.
Figure 8:
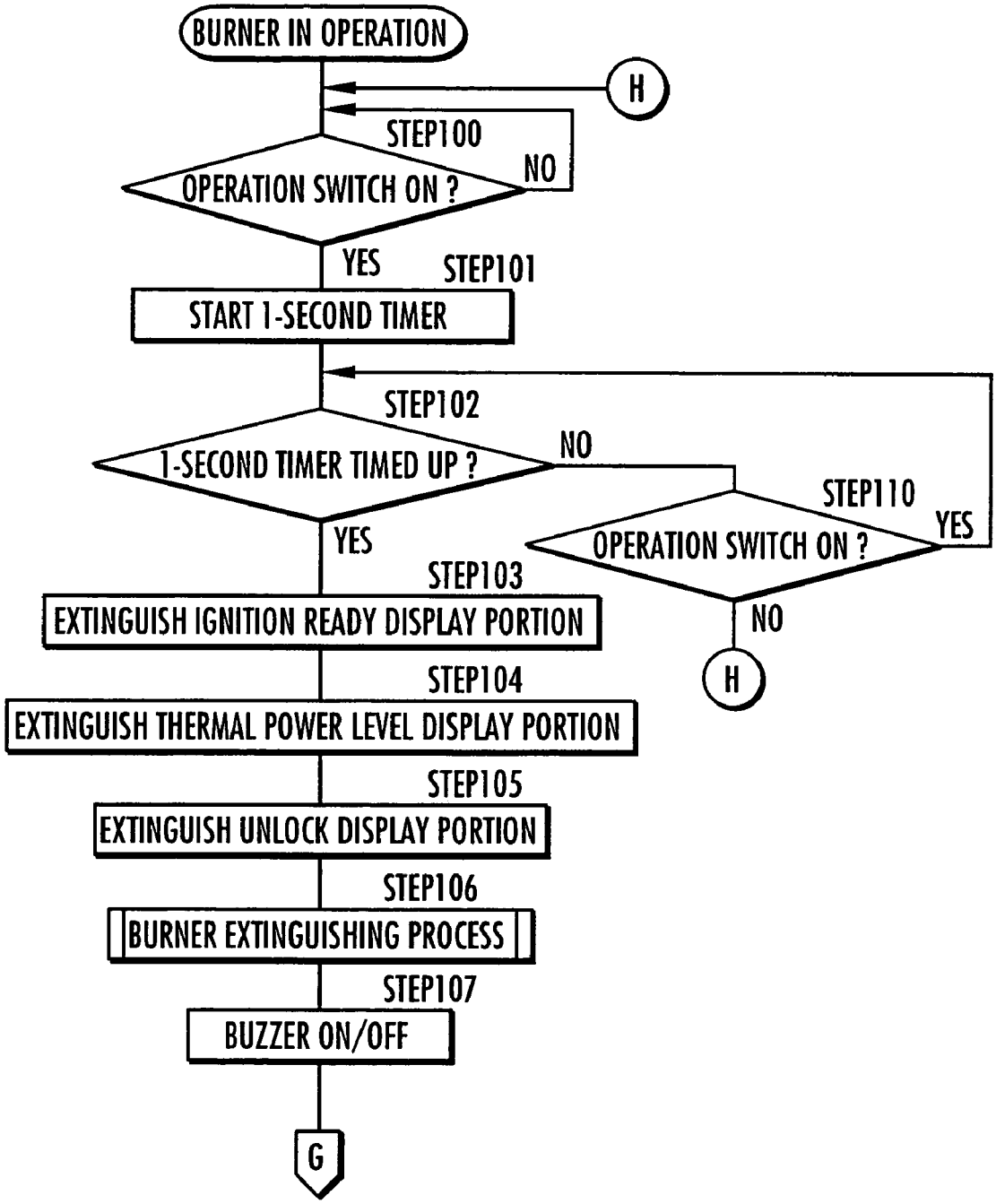
FIG. 8 is a flowchart of a burner extinguishing process.
Figure 9:
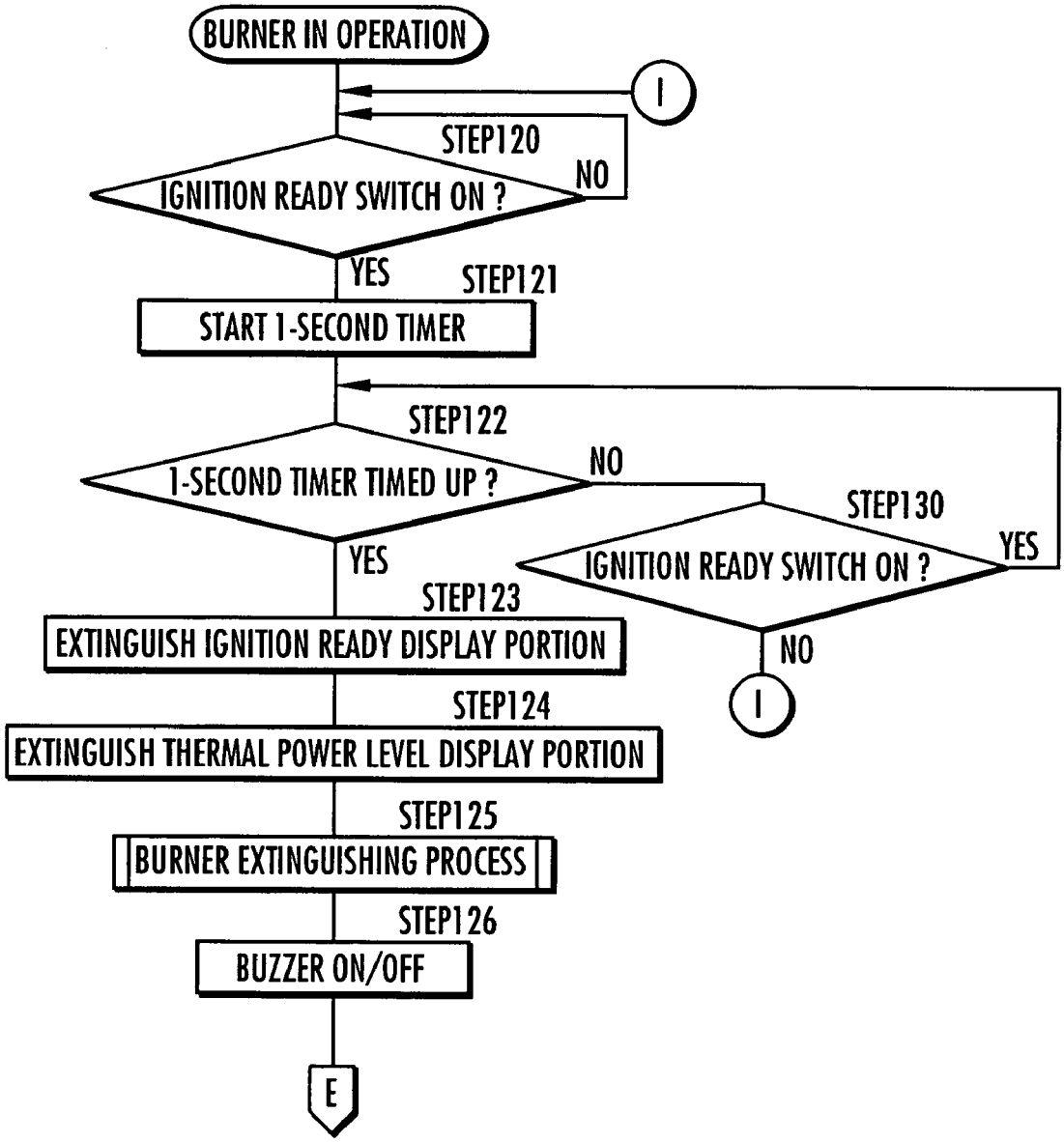
FIG. 9 is a flowchart of a burner extinguishing process.
Figure 10:
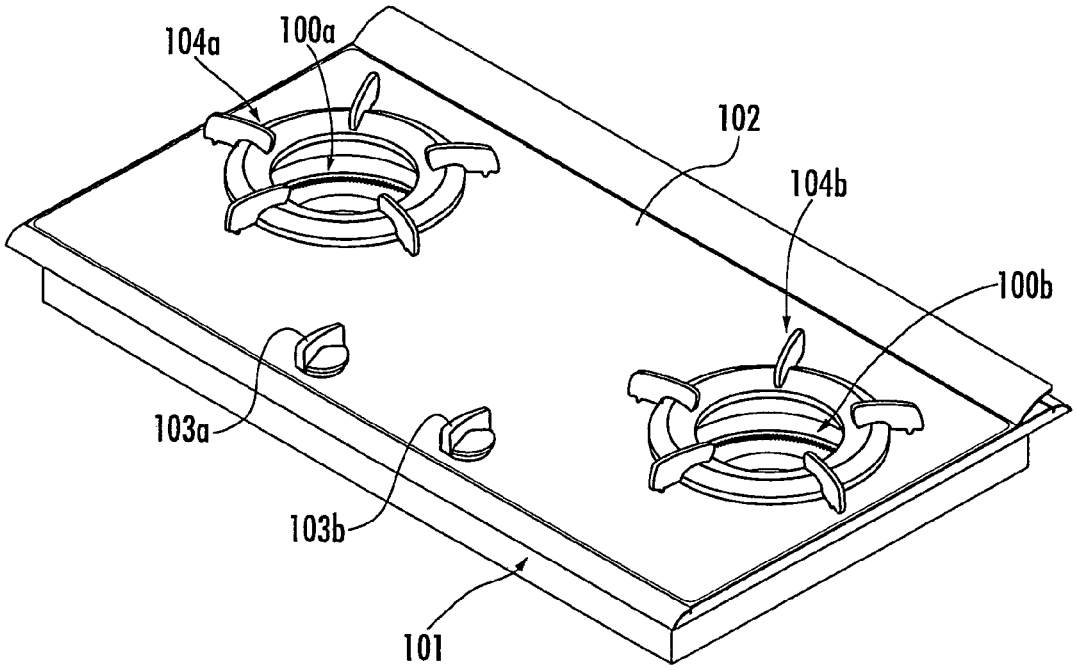
FIG.10 PRIOR ART
FIG. 10 is a diagram showing the appliance of a conventional cooking stove.

An embodiment of the present invention will be described with reference to FIGS. 1 to 9. FIG. 1 is a diagram showing the appearance of a cooking stove according to the present invention. FIG. 2 is a detailed diagram of an operation section shown in FIG. 1. FIG. 3 is a control block diagram of the cooking stove. FIGS. 4 to 6 are flowcharts of a process of turning on a burner. FIG. 7 is a flowchart of child lock and child unlock processes. FIGS. 8 and 9 are flowcharts of burner extinguishing processes.

Figure 1A:
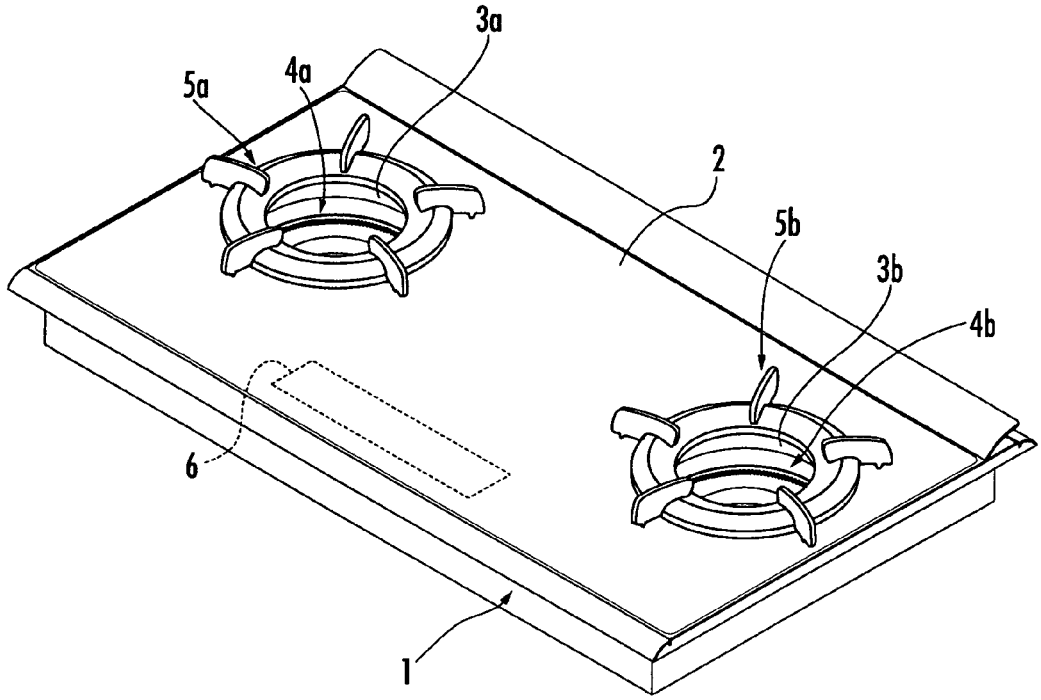
FIG. 1 is a diagram showing the appearance of a cooking stove according to the present invention.
Figure 1B:
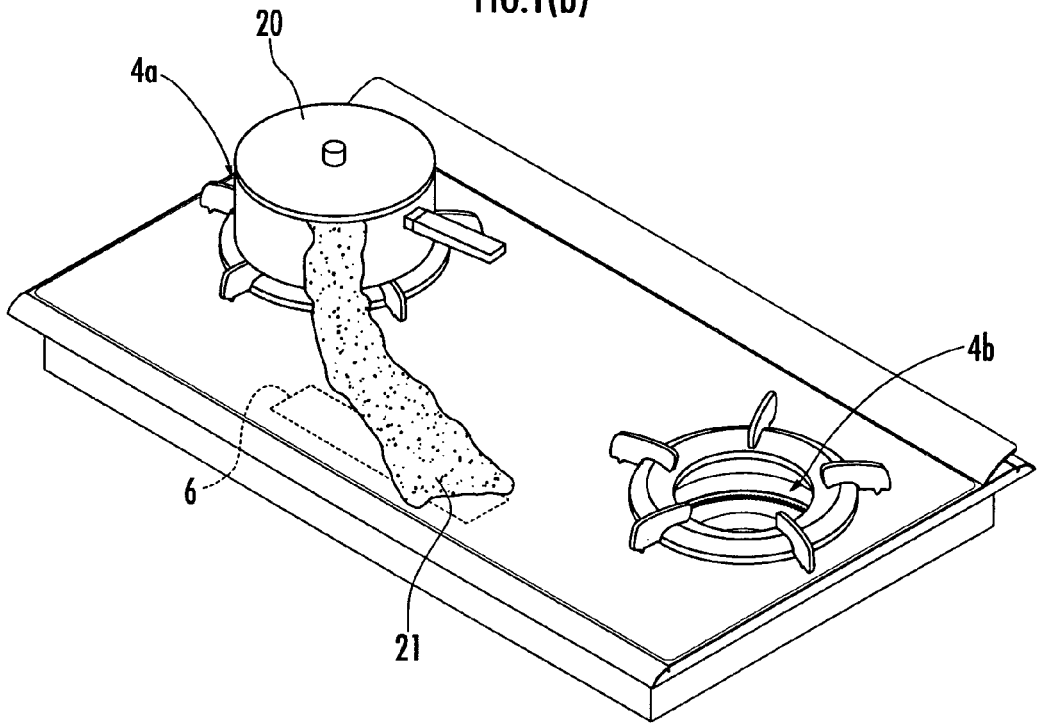

FIG. 1 shows a drop-in type cooking stove in which a glass top plate 2 formed of crystallized glass, which has an excellent heat resistance, is installed on a top surface of a cooking stove main body 1. A lateral pair of cooking stove openings 3*a* and 3*b* is formed in the glass top plate 2. With reference to FIG. 1A, a left burner 4*a* and a right burner 4*b* (corresponding to heating means according to the present invention) are provided in the cooking stove main body 1 so as to be viewed through the cooking stove openings 3*a* and 3*b*. Further, trivets 5*a* and 5*b* are arranged in the cooking stove openings 3*a* and 3*b*; cooking containers are placed on the trivets 5*a* and 5*b*. An operation section 6 is provided in the front of a top surface of the glass top plate 2 to give an instruction for activating the left burner 4*a* and the right burner 4*b*.

With reference to FIG. 2, the operation section 6 comprises an operation switch 10 that switches between an "operation state" in which the left burner 4*a* and the right burner 4*b* can be instructed on actuation while the cooking stove remains powered on and a "standby state" in which the burners cannot be instructed on actuation. In the "operation state", all the switches except the operation switch 10 can be operated. In the "standby state", no switches other than the operation switch 10 can be operated.

Further, in order to give an instruction on actuation of the left burner 4*a*, the operation portion 6 has an ignition ready switch 11*a* (corresponding to an actuation ready switch according to the present invention) that establishes an ignition ready state in which the left burner 4*a* is allowed to be ignited, a thermal power down switch 12*a* and a thermal power up switch 13*a* (corresponding to a heat quantity up switch according to the present invention) which switch the thermal power of the left burner 4*a* among five levels (levels 1 to 5), an ignition ready display portion 14*a* lighted while the left burner 4*a* is in the ignition ready state and while the left burner 4*a* is in operation, and a thermal power level display portion 15*a* that displays a thermal power setting for the left burner 4*a*.

While the left burner 4*a* is ready for ignition, when the thermal power up switch 13*a* is operated, the left burner 4*a* is ignited. On the other hand, while the left burner 4*a* is in operation, when the ignition ready switch 11*a* or the operation switch 10 is operated, the left burner 4*a* is turned off.

Similarly, to instruct the right burner 4*b* on actuation, the operation section 6 is provided with an ignition ready switch 11*b* (corresponding to an actuation ready switch according to the present invention) that allows the right burner 4*b* to get ready for, and to permit, ignition, a thermal power down switch 12*b* and a thermal power up switch 13*b* (corresponding to a heat quantity up switch according to the present invention) which switch the thermal power of the right burner 4*b* among five levels (levels 1 to 5), an ignition ready display section 14*b* that is lighted while the right burner 4*b* is ready for ignition or is in operation, and thermal power level display section 15*b* that displays a setting for the thermal power of the right burner 4*b*.

While the right burner 4*b* is ready for ignition, when the thermal power up switch 13*b* is operated, the right burner 4*b* is ignited. On the other hand, while the right burner 4*b* is in operation, when the ignition ready switch 11*b* or the operation switch 10 is operated, the right burner 4*b* is turned off.

Moreover, the operation section 6 comprises an unlock display section 16 that is lighted in the "operation state" and a lock display section 17 that is lighted when the operations of all the switches are disabled, that is, the appliance is brought into a child lock state, after the operation switch 10 has been continuously operated for more than a predetermined time (for example 4 seconds).

Each of the switches of the operation section 6 is a non-contact type touch switch composed of an electrical-capacitance sensor provided on a back surface of the glass top plate 2 and a print portion printed on a part of the front surface of the glass top plate 2 which is opposite the electrical-capacitance sensor, the print portion showing a touch point of the switch. When an electrostatic object is placed on the print portion (part of the front surface of the glass top plate 2 which is opposite the electrical-capacitance sensor), the electrical-capacitance sensor detects the electrostatic object to turn on the touch switch (this corresponds to a sensing state according to the present invention). When the electrostatic object is not placed on the print portion, the electrical-capacitance sensor does not detect the electrostatic object, the touch switch remains off (this corresponds to a non-sensing state according to the present invention).

Further, each of the display sections of the operation section 6 is composed of a LED provided on the back surface of the glass top plate 2 and a print portion printed on a part of the front surface of the glass top plate 2 which is opposite the LED. When the LED is turned on, the display section is lighted. When the LED is turned off, the display section is extinguished. The display portion may be composed only of lighting means such as a LED provided on the back surface of the glass top plate 2 instead of the print portion provided on the front surface of the glass top plate 2.

The thermal power level display section 15*a* indicates the thermal power level (levels 1 to 5) of the left burner 4*a* using the number of lighting portions lighted, the lighting portions being provided in a bar display consisting of five lighting portions; the lighting starts with the leftmost lighting portion and the number of lighting portions lighted increments as the thermal power increases. For example, when the thermal power level of the left burner 4*a* is 1, the only the leftmost lighting portion of the bar display is lighted. When the thermal power level of the left burner 4*a* is 5, the five lighting portions of the bar display are all lighted. Similarly, the thermal power level display section 15*b* indicates the thermal power level (levels 1 to 5) of the right burner 4*b* using the number of lighting portions lighted, the lighting portion being provided in a bar display consisting of five lighting portions; the lighting starts with the leftmost lighting portion and the number of lighting portions lighted increments as the thermal power increases.

Now, with reference to FIG. 3, the cooking stove main body 1 internally comprises a controller 30 that controls the general actuation of the cooking stove. A sensing signal for the operational state of each of the switches (operation switch 10, ignition ready switches 11*a* and 11*b*, thermal power down switches 12*a* and 12*b*, and thermal power up switches 13*a* and 13*b*) of the operation section 6 is input to the controller 30.

Control signals output by the controller 30 controls the actuation of a gas source valve 40 that switches between the supply of fuel gas to the cooking stove main body 1 and the blockage of the supply, a left burner open and close valve 41*a* that switches between the supply of fuel gas to the left burner 4*a* and the blockage of the supply, a left burner thermal power adjusting valve 42*a* that varies the flow rate of fuel gas supplied to the left burner 4*a*, a left burner igniter 43*a* that applies a high voltage to an ignition electrode (not shown) of the left burner 4*a* to cause spark discharge, a right burner open and close valve 41*b* that switches between the supply of fuel gas to the right burner 4*b* and the blockage of the supply, a right burner thermal power adjusting valve 42*b* that varies the flow rate of fuel gas supplied to the right burner 4*b*, and a right burner igniter 43*b* that applies a high voltage to an ignition electrode (not shown) of the right burner 4*b* to cause spark discharge.

Moreover, control signals from the controller 30 control lighting/extinction of the display sections provided in the operation section 6 (ignition ready display sections 14*a* and 14*b*, thermal power level display sections 15*a* and 15*b*, unlock display section 16, and lock display section 17) and turn-on and off of a buzzer 18.

The controller 30 also comprises heating control means 31 for controlling the actuation of the left burner 4*a* and right burner 4*b*, and lighting control means 32 for controlling the lighting/extinction of the display sections provided in the operation section 6 and reporting by the buzzer 18.

As described above, the touch switches provided in the operation section 6 sense whether or not an electrostatic object is present on the top surface of the glass top plate 2. Thus, even though the user does not touch any touch switches with his or her finger, any of the touch switches may be turned on as follows. While the user is using only the left burner 4*a* to heat a cooked material in a pan 20, as shown in FIG. 1(*b*) the cooked material may boil over from the pan and the boiling-over cooked material 21 reaches the operation section 6 to turn any of the touch switches for the right burner 4*b* from an off state to on state.

The touch switch may also be turned on if the user unconsciously touches it during cooking or if a child tampers with it, or if the operation portion 6 is covered with an object (cloth or cooked material) having fallen onto the glass top plate 2 or with a cooking container placed on the glass top plate 2.

Thus, the heating control means 31, provided in the controller 30, executes a process required to prevent the left burner 4*a* or right burner 4*b* from being inadvertently ignited when the touch switch is turned off contrary to the user's expectations owing to, for example, a factor different from the user's operation. This process will be described in accordance with the flow chart in FIGS. 4 to 9. The flowchart in FIGS. 4 to 9 corresponds to a process for the left burner 4*a*. However, this also applies to a process for the right burner 4*b*.

First, STEP 1 to STEP 6 correspond to a process required to allow the user to recognize that the operation switch 10 has been turned on and then off again. When the cooking stove is powered on to start actuating the controller 30, the cooking stove enters the "standby state". Then, the heating control means 31 waits for the operation switch 10 to be turned on in STEP 1 in FIG. 4.

Then, when the operation switch 10 is turned on, the process advances to STEP 2. The heating control means 31 then starts a 2-second timer and a 4-second timer. In the subsequent loop of STEP 3 and STEP 30, the heating control means 31 waits for the 2-second timer to time up in STEP 3, while confirming in STEP 30 that the operation switch 10 is kept on.

In STEP 3, when the 2-second timer times up, that is, the operation switch 10 is kept on for at least 2 seconds, the process advances to STEP 4. STEP 4 and STEP 5 are processing executed by the lighting control means 32. The lighting control means 32 lights the unlock display portion 16 and activates the buzzer 18. The user is thus noticed that the operation of the operation switch 10 has been accepted.

In STEP 30, when the operation switch 10 is turned off, the heating control means 31 can determine that the operation switch 10 was instantaneously turned on by noise or the like. Thus, in this case, the process returns to STEP 1. The heating control means 31 then waits for the operation switch 10 to be turned on again.

In the subsequent loop of STEP 6 and STEP 35, the heating control means 31 waits for the operation switch to be turned off in STEP 6, while confirming in STEP 35 that the 4-second timer has timed up.

In STEP 6, when the operation switch 10 is turned off, that is, the operation switch 10 is turned off within 4 seconds after the turn-on of the operation switch 10 in STEP 1, the process advances to STEP 7. The heating control means 31 then starts a 15-minute timer.

In STEP 35, when the 4-second timer times up, that is, the operation switch 10 is kept on for at least 4 seconds, the process advances to STEP 80 in FIG. 7. FIG. 7 shows a child lock process. The lighting control means 32 extinguishes the unlock display portion 16 in STEP 80, lights the lock display portion 17 in STEP 81, and activates the buzzer 18 in STEP 82.

Then, in STEP 83, the heating control means 31 waits for the operation switch 10 to be turned on. This keeps the cooking stove in a child lock state in which no switches can be operated until the operation switch 10 is operated to cancel the child lock state. When in the child lock state, the user touches the operation switch 10 to turn it on, the process proceeds from STEP 83 to STEP 84. The heating control means 31 then starts the 4-second timer.

Subsequently, in the subsequent loop of STEP 85 and STEP 90, the heating control means 31 waits for the 4-second timer to time up in STEP 85, while confirming in STEP 90 that the operation switch 10 is kept on. In STEP 85, when the 4-second timer times up, that is, in the child lock state, the user continuously touches and keeps the operation switch 10 on for at least 4 seconds. The process then advances to STEP 86. The lighting control means 32 extinguishes the lock display portion 17 in STEP 86 and activates the buzzer 18 in STEP 87. The process advances to STEP 1 in FIG. 4. This cancels the child lock state.

In STEP 6 in FIG. 4, when the operation switch 10 is turned off, that is, the operation switch 10 is turned off within 4 seconds after the turn-on of the operation switch 10 in STEP 1, the process advances to STEP 7. The controller 30 then starts a 15-minute timer.

STEP 8 to STEP 14 in FIG. 5 are processing required to determine that the ignition ready switch 11*a* has been turned on and then off again. In a loop of STEP 8 and STEP 40, the heating control means 31 waits for the ignition ready switch 11*a* to be turned on in STEP 8, while checking in STEP 40 whether or not the 15-minute timer has timed up. In STEP 8, when the ignition ready switch 11*a* is turned on, the process advances to STEP 9 in FIG. 5.

In STEP 40, when the 15-minute timer times up, that is, the operation switch 10 is not turned on within 15 minutes after the turn-off of the operation switch 10 in STEP 6, the process advances to STEP 41. The controller 30 then extinguishes the unlock display portion 16 in STEP 41, activates the buzzer 18 in STEP 42, and returns to STEP 1 to enter the "standby state". This allows the cooking stove to return to the "standby state" when an operation of igniting the left burner 4*a* is not performed within 15 minutes after the user has operated the operation switch 10.

In STEP 9 in FIG. 5, the heating control means 31 starts the 1-minute timer. Then, in the subsequent loop of STEP 10 and STEP 50, the heating control means 31 waits for the 1-second timer to time up in STEP 10, while checking in STEP 50 whether or not the ignition ready switch 11*a* is on. Then, in STEP 10, when the 1-second timer times up, that is, the ignition ready switch 11*a* is kept on for at least 1 second, the process advances to STEP 11.

In STEP 50, when the 1-second timer times up, that is, the ignition ready switch 11*a* is turned on for less than 1 second, the heating control means 31 can determine that the ignition ready switch 11*a* was instantaneously turned on by noise or the like. Thus, in this case, the process returns to STEP 7 in FIG. 4. The heating control means 31 then waits for the ignition ready switch 11*a* to be turned on.

STEP 11 and STEP 12 are processing executed by the lighting control means 32. The lighting control means 32 lights the ignition ready display portion 14*a* in STEP 11 and activates the buzzer 18 in STEP 12. Then, in STEP 13, the heating control means 31 starts a 2-second timer. In the subsequent loop of STEP 14 and STEP 55, the heating control means 31 waits for the ignition ready switch 11*a* to be turned off in STEP 14, while checking in STEP 55 whether or not the 2-second timer has timed up.

In STEP 14, when the ignition ready switch 11*a* is turned off, that is, the ignition ready switch 11*a* is turned off within 2 seconds after the ignition ready switch 11*a* has been kept on for 1 second, the process advances to STEP 15. The heating control means 31 then starts a 10-second timer.

In STEP 55, when the 2-second timer times up, that is, the ignition ready switch 11*a* is kept on for 1 second and further for 2 seconds, the process advances to STEP 56. Then, the controller 30 extinguishes the ignition ready display portion 14*a* in STEP 56 and activates the buzzer 18 in STEP 57. The process then returns to STEP 7 in FIG. 4. Thus, when a boiling-over cooked material or the like causes the ignition ready switch 11*a* to remain on, the processing in and after STEP 15 is prohibited. The ignition of the left burner 4*a* is not carried out.

Then, STEP 15 to STEP 19 in FIG. 6 are processing required to determine that the thermal power up switch 13*a* has been turned on and then off again. In STEP 15, the heating control means 31 starts a 10-second timer. The process then advances to STEP 16. In a loop of STEP 16 and STEP 60, the heating control means 31 waits for the thermal power switch 13*a* to be turned on in STEP 16, while checking in STEP 60 whether or not the 10-second timer has timed up.

In STEP 16, when the thermal power up switch 13*a* is turned on, that is, the thermal power up switch 13*a* is turned on within 10 seconds after the ignition ready switch 11*a* has been turned off, the process advances to STEP 17. STEP 17 and STEP 18 are processing executed by the lighting control means 32. The lighting control means 32 lights the thermal power level display portion 15*a* at the level 4 in STEP 17 and activates the buzzer 18 in STEP 18. The process advances to STEP 19.

In STEP 16, when the thermal power up switch 13*a* is turned on, the thermal power level display portion 15*a* is lighted in STEP 17 before the left burner 4*a* is ignited in STEP 20 as described later. This notices the user that the ignition instruction has been accepted.

In STEP 60, when the 10-second timer times up, that is, the thermal power up switch 13*a* is not turned on within 10 seconds after the ignition ready switch 11*a* has been turned off, the process advances to STEP 61. STEP 61 and STEP 62 are processing executed by the lighting control means 32. The lighting control means 32 extinguishes the ignition ready display portion 14*a* in STEP 61 and activates the buzzer 18 in STEP 62. The process returns to STEP 7 in FIG. 4. Thus, the heating control means 31 waits for the ignition ready switch 11*a* to be turned on again.

In a loop of STEP 19 and STEP 65, the heating control means 31 waits for the thermal power switch 13*a* to be turned off in STEP 19, while checking in STEP 65 whether or not the 10-second timer has timed up. In STEP 19, when the thermal power up switch 13*a* is turned off, the process advances to STEP 20. The heating control means 31 actuates an igniter 43*a* to cause an ignition electrode to generate spark discharge. The heating control means 31 then opens the gas source valve 40 and the left burner open and close valve 41*a*. The heating control means 31 further sets the left burner thermal power adjusting valve 42*a* to the thermal power level 4 to ignite the left burner 4*a*.

In STEP 65, when the 10-second timer times up, that is, the turn-on and subsequent turn-off of the thermal power up switch 13*a* is not carried out within 10 seconds after the ignition ready switch 11*a* has been turned on, the process advances to STEP 66. STEP 66 to STEP 68 are processing executed by the lighting control means 32. The lighting control means 32 extinguishes the ignition ready display portion 14*a* in STEP 66, extinguishes the thermal power level display portion 15*a*, and activates the buzzer 18 in STEP 68. The process returns to STEP 7 in FIG. 4.

As described above, after the operation switch 10 has been turned on and then off again, the ignition ready switch 11*a* is turned on and then off again, and then the thermal power up switch 13*a* is turned on and then off again. Then, the heating control means 31 executes ignition of the left burner 4*a* (corresponding to the start of actuation of the heating means according to the present invention).

This prevents the left burner 4*a* from being ignited even if a boiling-over cooked material or the like turns on the operation switch 10, the ignition ready switch 11*a*, and the thermal power up switch 13*a*. Further, the left burner 4*a* is ignited only if these three switches are turned on and then off again in order of the operation switch 10, the ignition ready switch 11*a*, and the thermal power up switch 13*a*.

It seems unlikely that a boiling-over cooked material or the like turns these switches on and then off again in the above order. Accordingly, it is possible to reliably prevent ignition of the left burner 4*a* from being carried out owing to a factor different from the user's operation.

Further, the left burner 4*a* is not ignited if the user unconsciously touches the operation portion 6 or if a child tampers with the operation portion 6 or if a boiling-over cooked material or the like turns on or further turns off again only one of the operation switch 10, ignition ready switch 11*a*, and thermal power up switch 13*a*.

Furthermore, even in the "operation state", the left burner 4*a* is not ignited when only one of the ignition ready switch 11*a* and thermal power up switch 13*a* is turned on or further turned off again.

FIGS. 8 and 9 are flowcharts of an operation of extinguishing a burner. FIG. 8 is a flowchart showing the case in which the operation switch 10 is turned on while the burner is in operation. FIG. 9 is a flowchart showing the case in which the ignition ready switch 11*a* is turned on while the burner is in operation.

First, with reference to FIG. 8, when the operation switch 10 is turned on while the left burner 4*a* is in operation, the process advances from STEP 100 to STEP 101. The heating control means 31 then starts a 1-second timer. Then, in a loop of STEP 102 and STEP 110, the heating control means 31 waits for the 1-second timer to time up in STEP 102, while checking in STEP 110 whether or not the operation switch 10 is on.

In STEP 102, when the 1-second timer times up, that is, the operation switch 10 is kept on for at least 1 second, the process advances to STEP 103. STEP 103 to STEP 105 and STEP 107 are processing executed by the lighting control means 32. In STEP 103 to STEP 105, the lighting control means 32 extinguishes the ignition ready display portion 14*a*, the thermal power level display portion 15*a*, and the unlock display portion 16.

In STEP 106, the heating control means 31 closes the left burner open and close valve 41*a* and gas source valve 40 to extinguish the left burner 4*a*. In STEP 107, the lighting control means 32 activates the buzzer 18 to notice the user that the burner 4*a* has been extinguished. The process then returns to STEP 1 in FIG. 4.

With reference to FIG. 9, when the ignition ready switch 11*a* is turned on while the left burner 4*a* is in operation, the process advances from STEP 120 to STEP 121. The controller 30 then starts a 1-second timer. Then, in a loop of STEP 122 and STEP 130, the controller 30 waits for the 1-second timer to time up in STEP 122, while checking in STEP 130 whether or not the ignition ready switch 11*a* is on.

In STEP 122, when the 1-second timer times up, that is, the ignition ready switch 11*a* is kept on for at least 1 second, the process advances to STEP 123. STEP 123, STEP 124, and STEP 126 are processing executed by the lighting control means 32. In STEP 123 and STEP 124, the lighting control means 32 extinguishes the ignition ready display portion 14*a* and the thermal power level display portion 15*a*.

In STEP 125, the heating control means 31 closes the left burner open and close valve 41*a* to extinguish the left burner 4*a*. In STEP 126, the lighting control means 32 activates the buzzer 18 to notice the user that the burner 4*a* has been extinguished. The process then returns to STEP 7 in FIG. 4.

As described above, the left burner 4*a* is ignited when the operation switch 10, the ignition ready switch 11*a*, and the thermal power up switch 13*a* are turned on and then off again. This means that when the user performed an operation of igniting the left burner 4*a*, the heating control means 31 had determined that none of the operation switch 10, ignition ready switch 11*a*, and thermal power up switch 13*a* were in an off failure (a failure that prevents the switch from being turned on) state.

As shown in FIGS. 8 and 9, by executing a process of extinguishing the left burner 4*a* after the operation switch 10 and the ignition ready switch 11*a*, which were not in the off failure state when an ignition operation was performed, have been turned on, it is possible to inhibit the extinction of the left burner 4*a* from being disabled by an off failure in the switches.

In the present embodiment, the cooking stove comprising the gas burners 4*a* and 4*b* are shown as heating means according to the present invention. The present invention is applicable to a cooking stove comprising another type of heating means such as an electric heater.

In the present embodiment, the illustrated cooking stove comprises the glass top plate 2, composed of heat-resistant glass, as a top plate according to the present invention. However, the present invention is applicable to a cooking stove comprising a top plate composed of a different material such as stainless steel.

In the present embodiment, the illustrated cooking stove employs the electrical capacitance touch switches as touch switches according to the present invention. However, the type of the touch switches is not limited to this. The present invention is applicable to a cooking stove employing photo switches comprising an infrared emitting/receiving section or mechanical point type touch switches such as tact switches.

In the present embodiment, the illustrated cooking stove comprises two burners as heating means. However, the present invention is applicable to a cooking stove comprising one or at least three heating means.

In the present embodiment, the illustrated cooking stove comprises the operation switch. However, the effects of the present invention can be produced even if the cooking stove has no operation switch.

In the present embodiment, the thermal power up switches 13*a* and 13*b* are also used to give instructions on ignition of the left burner 4*a* and the right burner 4*b*, respectively, thus reducing the number of touch switches in the operation portion 6. However, it is possible to provide switches used to give instructions on ignition of the left burner 4*a* and the right burner 4*b*, separately from the thermal power up switches 13*a* and 13*b*.

What is claimed is:

1. A cooking stove comprising:

a touch switch provided on a top plate covering a top surface of a cooking stove main body accommodating heating means, the touch switch allowing a user to give an instruction on actuation and stoppage of the heating means, the touch switch sensing an object that contacts or approaches the top surface of the top plate; and heating control means for determining whether the touch switch is in a sensing state or a non-sensing state to control actuation of the heating means in accordance with a result of the determination, wherein while the heating means is at a stop, when the touch switch shifts from the non-sensing state to the sensing state and then back to the non-sensing state, the heating control means starts actuating the heating means, and while the heating means is in operation, when the touch switch shifts from the non-sensing state to the sensing state, the heating control means stops actuating the heating means.

2. The cooking stove according to claim 1, further comprising a plurality of the touch switches, wherein while the heating means is at a stop, when at least pre-selected two of the plurality of switches shift from the non-sensing state to the sensing state, the heating control means starts actuating the heating means.

3. The cooking stove according to claim 2, wherein while the heating means is at a stop, when at least pre-selected two of the plurality of switches shift from the non-sensing state to the sensing state in a preset order, the heating control means starts actuating the heating means.

4. The cooking stove according to claim 3, further comprising heat quantity changing means for changing the heat quantity of the heating means, wherein the plurality of touch switches include an actuation ready switch used to allow the heating means to be activated and a heat quantity up switch used to instruct the heat quantity changing means to increase the heat quantity of the heating means, and wherein when the actuation ready switch shifts from the non-sensing state to the sensing state and then the heat quantity up switch shifts from the non-sensing state to the sensing state, in accordance with the preset order, the heating control means starts actuating the heating means.

5. The cooking stove according to claim 2, further comprising at least two heating means, wherein one of the plurality of switches is an operation switch used to shift between an operation state in which the user can operate the other touch switches and a standby switch in which the user cannot operate the other touch switches, and in the operation state, when the at least two of the plurality of touch switches shift from the non-sensing state to the sensing state, the two touch switches being pre-selected for the respective heating means and being different from the operation switch, the heating control means start actuating the heating means corresponding to the at least two touch switches.

6. The cooking stove according to claim 5, further comprising heat quantity changing means provided individually for the at least two heating means, wherein the plurality of touch switches include actuation ready switches provided individually for the at least two heating means to allow each heating means to be activated and heat quantity up switches used to instruct the heat quantity changing means to increase the heat quantities of the respective heating means, and wherein in the operation state, when the actuation ready switch provided for one of the heating means shifts from the non-sensing state to the sensing state and then the heat quantity up switch provided for the heating means shifts from the non-sensing state to the sensing state, the heating control means starts actuating the heating means.

7. The cooking stove according to claim 2, wherein when the heating means is in operation and one of the pre-selected touch switches shifts from the non-sensing state to the sensing state, the heating control means stops actuating the heating means.

8. The cooking stove according to claim 1, further comprising lighting means provided on the top plate; and lighting control means for, while the heating means is in operation, lighting the lighting means, and while the heating means is in suspension, when the touch switch shifts from the non-sensing state to the sensing state, lighting the lighting means before the heating control means starts actuating the heating means.

* * * * *